US010265230B2

(12) United States Patent
Trask

(10) Patent No.: US 10,265,230 B2
(45) Date of Patent: Apr. 23, 2019

(54) EXERCISE APPARATUS AND METHOD OF USE

(71) Applicant: Lorelei Trask, Ontario, CA (US)

(72) Inventor: Lorelei Trask, Ontario, CA (US)

( * ) Notice: Subject to any disclaimer, the term of this patent is extended or adjusted under 35 U.S.C. 154(b) by 205 days.

(21) Appl. No.: 14/952,881

(22) Filed: Nov. 25, 2015

(65) Prior Publication Data

US 2017/0143563 A1 May 25, 2017

Related U.S. Application Data

(63) Continuation-in-part of application No. 14/740,240, filed on Jun. 15, 2015, now Pat. No. 9,889,061.

(60) Provisional application No. 62/085,073, filed on Nov. 26, 2014.

(51) Int. Cl.

| | |
|---|---|
| ***A61H 3/02*** | (2006.01) |
| ***A61G 5/12*** | (2006.01) |
| *A61H 3/00* | (2006.01) |

(52) U.S. Cl.

CPC ..... *A61G 5/12* (2013.01); *A61H 3/02* (2013.01); *A61H 3/0288* (2013.01); *A61G 2005/127* (2013.01); *A61H 2003/005* (2013.01); *A61H 2201/0161* (2013.01); *A61H 2201/0192* (2013.01); *A61H 2201/164* (2013.01); *A61H 2201/168* (2013.01); *A61H 2209/00* (2013.01)

(58) Field of Classification Search

CPC ..... A61H 3/02; A61H 3/00; A61H 3/0288; A61H 2003/005; A61H 2201/1652; A61H 2201/0173; A61H 2201/1685; A45C 13/002; A61G 5/12; A61G 5/14; A61G 5/127; A61G 5/128; B60N 3/06

USPC ..... 135/65, 66, 68, 76, 86, 69, 71–74, 84; 150/154–155, 165, 158; 446/177, 369, 446/375; 297/423.18, 423.23, 423.25, 297/423.26

See application file for complete search history.

(56) References Cited

U.S. PATENT DOCUMENTS

| | | | | | |
|---|---|---|---|---|---|
| 2,403,632 | A | * | 7/1946 | Brown | A45B 9/04 135/84 |
| 2,614,613 | A | * | 10/1952 | Bushong | A47C 16/02 297/183.3 |
| 4,711,261 | A | * | 12/1987 | Rosenberg | A61H 3/02 128/DIG. 15 |
| 4,910,927 | A | * | 3/1990 | Beatty | A61H 3/02 135/66 |
| 4,922,941 | A | * | 5/1990 | Daniels | A61H 3/02 135/66 |
| 5,078,640 | A | | 1/1992 | Berman | |
| 5,101,846 | A | | 4/1992 | Greatwood | |
| 5,333,921 | A | | 8/1994 | Dinsmoor, III | |
| 5,343,375 | A | | 8/1994 | Gross et al. | |
| 5,402,811 | A | * | 4/1995 | Weng | A61H 3/02 135/68 |
| 5,411,045 | A | * | 5/1995 | Davis | A61H 3/00 135/83 |

(Continued)

*Primary Examiner* — Winnie Yip

(74) *Attorney, Agent, or Firm* — Loza & Loza, LLP; Heidi L. Eisenhut

(57) ABSTRACT

Disclosed are handicap apparatus using (a) one or more resilient, snap-on bumper structures, (b) unique tips covers, (c) leg elevating units, (d) resilient structures having a density that provides a softer exterior and a harder interior. The handicap apparatus includes crutches, canes, wheelchairs, scooters, and walkers.

12 Claims, 15 Drawing Sheets

(56) References Cited

U.S. PATENT DOCUMENTS 5,978,962 A * 11/1999 Hamowy ..... A41D 13/0568 2/16
6,085,765 A * 7/2000 Sigsworth ..... A61H 3/02 128/878
6,165,035 A 12/2000 Avner
6,718,994 B2 4/2004 Lewis
7,204,262 B2 * 4/2007 DeMay ..... A61H 3/02 135/68
7,614,414 B2 * 11/2009 Jamshidi ..... A61H 3/02 135/66
7,648,251 B2 1/2010 Whitehouse et al.
8,146,615 B1 * 4/2012 Rodriguez ..... A61H 3/02 135/66
8,215,325 B2 * 7/2012 Montanti ..... A45B 1/00 135/65
8,388,214 B1 3/2013 Toro et al.
8,500,578 B2 8/2013 Mohr et al.
2003/0214162 A1 * 11/2003 Romano ..... A61H 3/0277 297/227
2007/0074749 A1 * 4/2007 Jones ..... A61H 3/02 135/73
2009/0104837 A1 * 4/2009 Manwaring ..... A63H 3/02 446/71
2011/0030747 A1 * 2/2011 Lee ..... A45B 7/00 135/66
2012/0227776 A1 * 9/2012 Neitzel ..... A61H 3/02 135/73
2014/0096804 A1 * 4/2014 Keck ..... A61H 3/02 135/69

* cited by examiner

L2
b1
A1
A1
L1
610b
610
610C
b1
620
10C

Spring Board Lock
611
611

10E
10E
610A
610b
610

610A
610b
610
610

610
A1
L2
L1
A1
611
610
610A
610b
613

611
L1
L2
611
610
610A
610b
613

610 b1
b1
620
620A
620b
613

617
620

620
b1
b1
617
620
613

103
A1
631
630
b1
620

100
185

153
170
L 100C
109A 100F
103
L
L 100d
103
L
109A
170
100E
L
100G
170
L

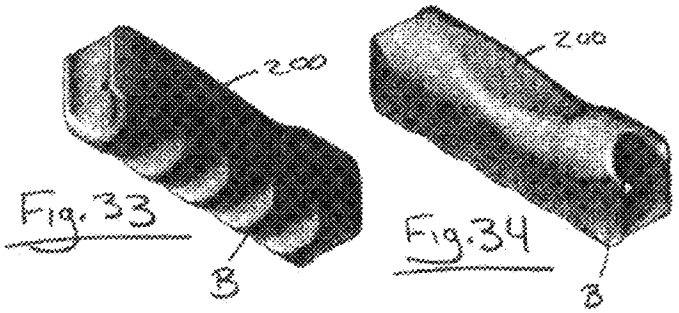
Fig. 33
Fig. 34
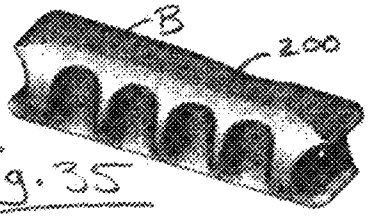
Fig. 35
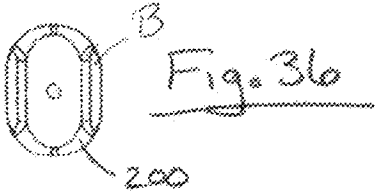
Fig. 36
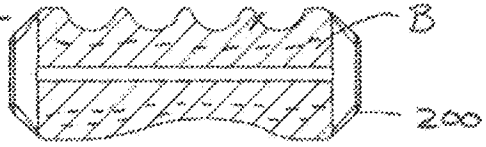
Fig. 37
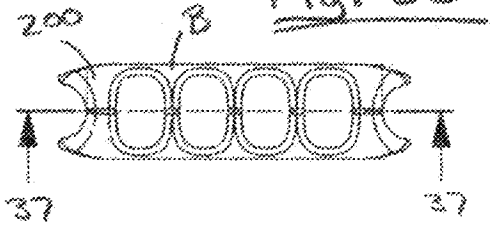
Fig. 38
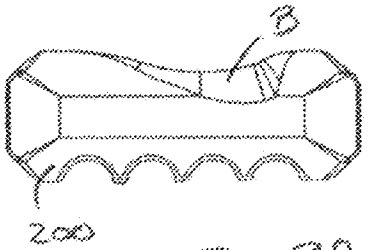
Fig. 39

15
15A
400d
416b
410
416
410b
410c 15
400c
418
410b
410c 15
412b
416
412c
R
412A
452
410
410ab
418
P
412

15
450
412b 15
450
412b

Fig 67
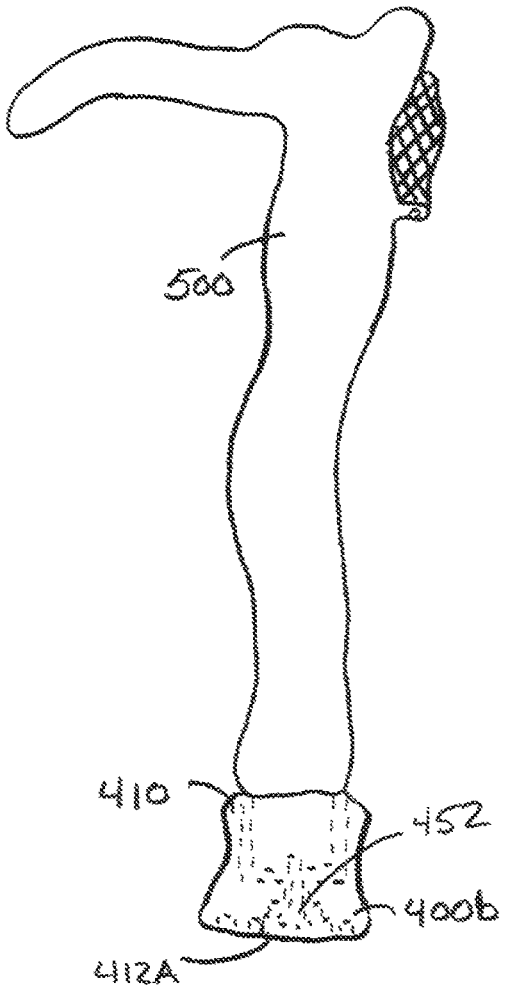
Fig 68
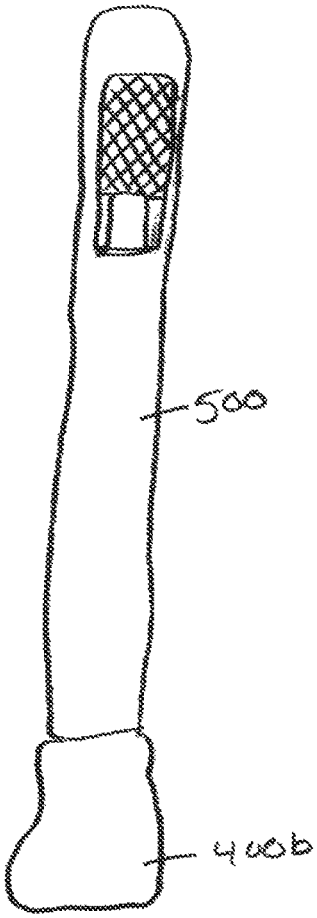
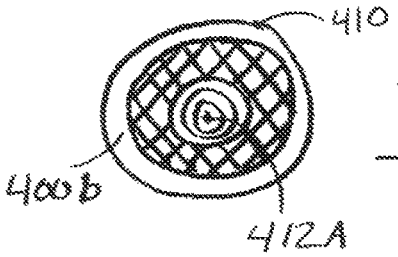
Fig 69

502

502

502
450
502
100b
452
504

504

504
450

504
450

100b
452

EXERCISE APPARATUS AND METHOD OF USE

RELATED PATENT APPLICATIONS & INCORPORATION BY REFERENCE

This continuation-in-part utility application claims the benefit under 35 USC § 120 of U.S. utility patent application Ser. No. 14/740,240, filed Jun. 15, 2015 (herein Parent Application), which in turn claims the benefit under 35 USC § 119(e) of U.S. Provisional Patent Application No. 62/085,073, filed Nov. 26, 2014, entitled Medical Equipment, Covers, Systems, Functions and Methods of Use. These related applications are incorporated herein by reference and made a part of this application. If any conflict arises between the disclosure of the invention in this utility application and that in the related applications, the disclosure in this utility application shall govern. Moreover, any and all U.S. patents, U.S. patent applications, and other documents, hard copy or electronic, cited or referred to in this application are incorporated herein by reference and made a part of this application.

BACKGROUND

In the Parent Application improvements in handicap apparatus are disclosed. Crutches, walkers, scooters and wheel chairs, and other apparatus for assisting handicapped individuals typically do not have means to adequately elevate the leg of a user while seated. Many handicapped patients, however, have poor circulation, especially in their legs. Elevating their leg or legs would be beneficial. Nor does such handicap apparatus usually provide a leg pillow type structure for the comfort of the user. Moreover, the tips of crutches disclosed in the Parent Application that engage the ground are problematic, for example, attached tip covers frequently detach. The bumper structures and other features disclosed in the Parent Application can also be enhanced as discussed herein.

Definitions

The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

SUMMARY

My handicap apparatus and method of use have one or more of the features depicted in the embodiments discussed in the section entitled "DETAILED DESCRIPTION OF SOME ILLUSTRATIVE EMBODIMENTS." These features are not listed in any rank order nor is this list intended to be exhaustive. The claims that follow define my handicap apparatus and method of use, distinguishing them from the prior art; however, without limiting the scope of handicap apparatus and method of use as expressed by these claims, in general terms, some, but not necessarily all, of their features are:

One embodiment of handicap apparatus is crutch including one or more resilient, snap-on bumper structures. Such a structure is mounted to one or more of the poles of the crutch in a manner that the structure projects outwardly from the poles. The bumper structures comprise a resilient body that varies in density to provide a softer exterior and a harder interior. For example, the resilient body may be rubber. A connector element can be used to attach a pair of crutch side poles together that functions as a handle that extends between the side poles and is positioned so a user can grasp the connector element while using the crutch. This connector element may have a resilient body that varies in density to provide a softer exterior and a harder interior. An upper end portion of a center pole of the crutch may have a cap member attached thereto in the form of a bumper structure comprising a resilient body that varies in density to provide a softer exterior and a harder interior.

Two, in a second embodiment of my handicap apparatus a lower end portion of a central pole of the crutch terminates in a tip that is inserted into a tip cover. The tip cover has a rigid body forming a receptacle with a floor and a open mouth that receives the tip of the center pole. The floor may include a honeycomb matrix of spaced apart open spaces in the body.

Three, in a third embodiment of my handicap apparatus the tip cover may be detachable. For example, a fastener passes through the tip cover to connect the tip cover to a pole of the apparatus. Typically, the pole is elongated and rigid, having a hollow interior and terminating in an edge. A plug is inserted into the hollow interior, being configured to fit snug within the interior. This plug has a face end including a rim projecting generally at a aright angle from a side of the plug that abuts and overlaps the edge upon insertion of the plug into the hollow interior. The rim acts as a stop to prevent further movement of the plug into the interior of the pole upon engaging the edge. The plug may have in the face end a site configured to attach an end of a fastener.

In this third embodiment of my handicap apparatus a tip cover is employed that is configured to receive the pole with the plug therein and has a rigid body including a top end, a bottom end, and a receptacle. The receptacle extends from the top end partially into the body and terminates in a floor with a passageway that extends from the floor to the bottom end. The passageway terminates in the bottom end in a recess. A fastener, for example a bolt or screw, extends through the passageway. This fastener has a first end that attaches to the site at the face end of the plug, pulling the rim of the plug snug against the floor of the receptacle as the fastener is attached, and a second end that is seated in the recess inward of the bottom end when the fastener is completely tightened. The edge has a perimeter with predetermined dimensions, for example, circular, and the rim generally has the same dimensions as the perimeter of the edge and the receptacle has perimeter dimensions the same as the perimeter of the edge to fit snug within the hollow interior. The pole has a central reference line and the rim is at a right angle to the reference line, and the rigid body comprises a molded rubbery material.

In a fourth embodiment, an elevation unit is employed for elevating a leg of a user while the user is in a seated position. In this fourth embodiment, an elongated platform is configured to be mounted to a handicap apparatus, for example, a crutch, walker, scooter, or wheelchair. The platform may have a predetermined shape enabling the leg of a patient to be positioned comfortably lengthwise along the platform. The platform has opposed ends and is moveable between a first position where a first end of the platform is elevated with respect to a second end of the platform. A lifting mechanism is included that enables a patient to manually move the platform between the first and second positions and move the elevated platform laterally. For example, the second end is mounted to pivot and the lifting mechanism includes legs at the first end that are extended upon elevating the platform into the first position. The platform may include a pillow member that at least partially covers the platform. The pillow member may be detachably connected to the platform.

My method improves circulation in a leg of a patient and comprises the steps of (a) placing one end of a crutch on a seat, said crutch including an elevation unit with an elongated platform positioned lengthwise along the unit, the platform having opposed ends and being moveable between a first position where a first end of the platform is elevated with respect to a second end of the platform, and (b) with the patient siting in a seated position on the seat, placing one leg of the patient on the elevated platform. The elevated leg is horizontally oriented or above the horizontal by no more that 35 degrees.

These features are not listed in any rank order nor is this list intended to be exhaustive.

DESCRIPTION OF THE DRAWING

Some embodiments of my handicap apparatus and method of use are discussed in detail in connection with the accompanying drawing, which is for illustrative purposes only. This drawing includes the following figures (Figs.), with like numerals and letters indicating like parts:

FIGS. 33 through 39 illustrate the handle that extends between side poles of my crutch where FIG. 33 is a perspective looking at the bottom of the handle, FIG. 34 is a perspective looking at the top of the handle, FIG. 35 is a perspective looking at the side of the handle, FIG. 36 is an end view of the handle, FIG. 37 is a cross-sectional view taken along line 37-37 of FIG. 38, FIG. 38 is a bottom view of the handle, and FIG. 39 is a side view of the handle.

FIGS. 40 through 44 are views of bumpers having either an exterior flange FIGS. 41 and 42 or interior flanges 43 and 44, FIGS. 45 through 47 are views of bumpers having a lower threaded portion, and FIGS. 48 through 53 are views of cap members of the snap-on type.

FIG. 54 is a perspective view of the tip cover looking at the top of the cover, FIG. 55 is a perspective view of the tip cover looking at the bottom of the cover, FIG. 56 is a bottom plan view of the tip cover, FIG. 57 is a side view of the tip cover, FIG. 58 is a cross-sectional view taken along line 58-58 of FIG. 57, FIG. 59 is top plan view of the tip cover, FIG. 60 is perspective view of a cross-section of the tip cover shown in FIG. 54.

FIG. 61 is perspective view of an alternate embodiment of the tip cover.

FIG. 67 is a side view of a cane employing my unique pole tip depicted in FIG. 63.

FIG. 68 is an edge view of the cane shown in FIG. 67.

FIG. 69 is a plan view of the bottom end of the cane shown in FIG. 67.

DETAILED DESCRIPTION OF SOME ILLUSTRATIVE EMBODIMENTS

Figure 11A:
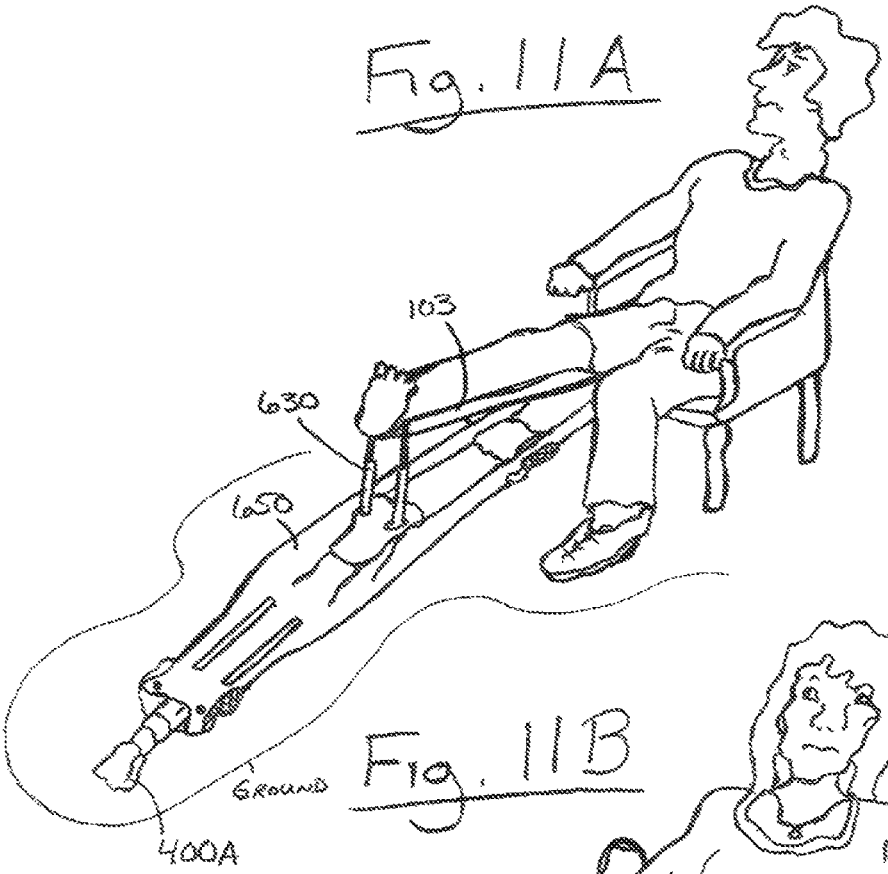
FIG. 11A is a side perspective view of a user positioning the crutch above ground level and deploying the elevation unit.
Figure 11B:
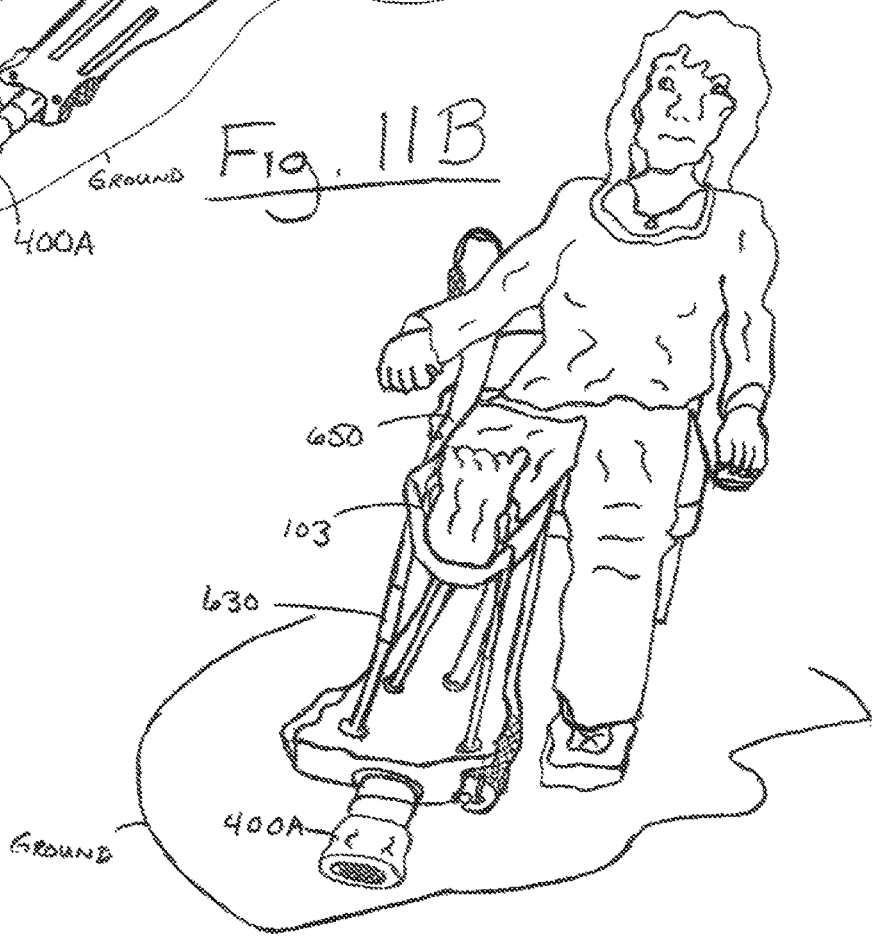
FIG. 11B is a front perspective view of a user positioning the crutch above ground level and deploying the elevation unit.
Figure 12:
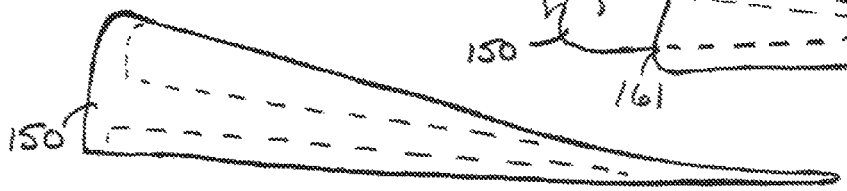
FIG. 12 is an alternate embodiment of a pillow member.
Figure 13:
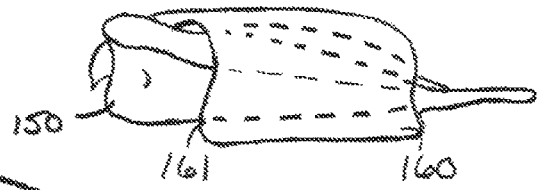
FIG. 13 is a perspective view of pillow member shown in FIG. 12 having a blanket attached thereto.
Figures 70, 70A, 70B, 71, 71A, 71B, 71C:
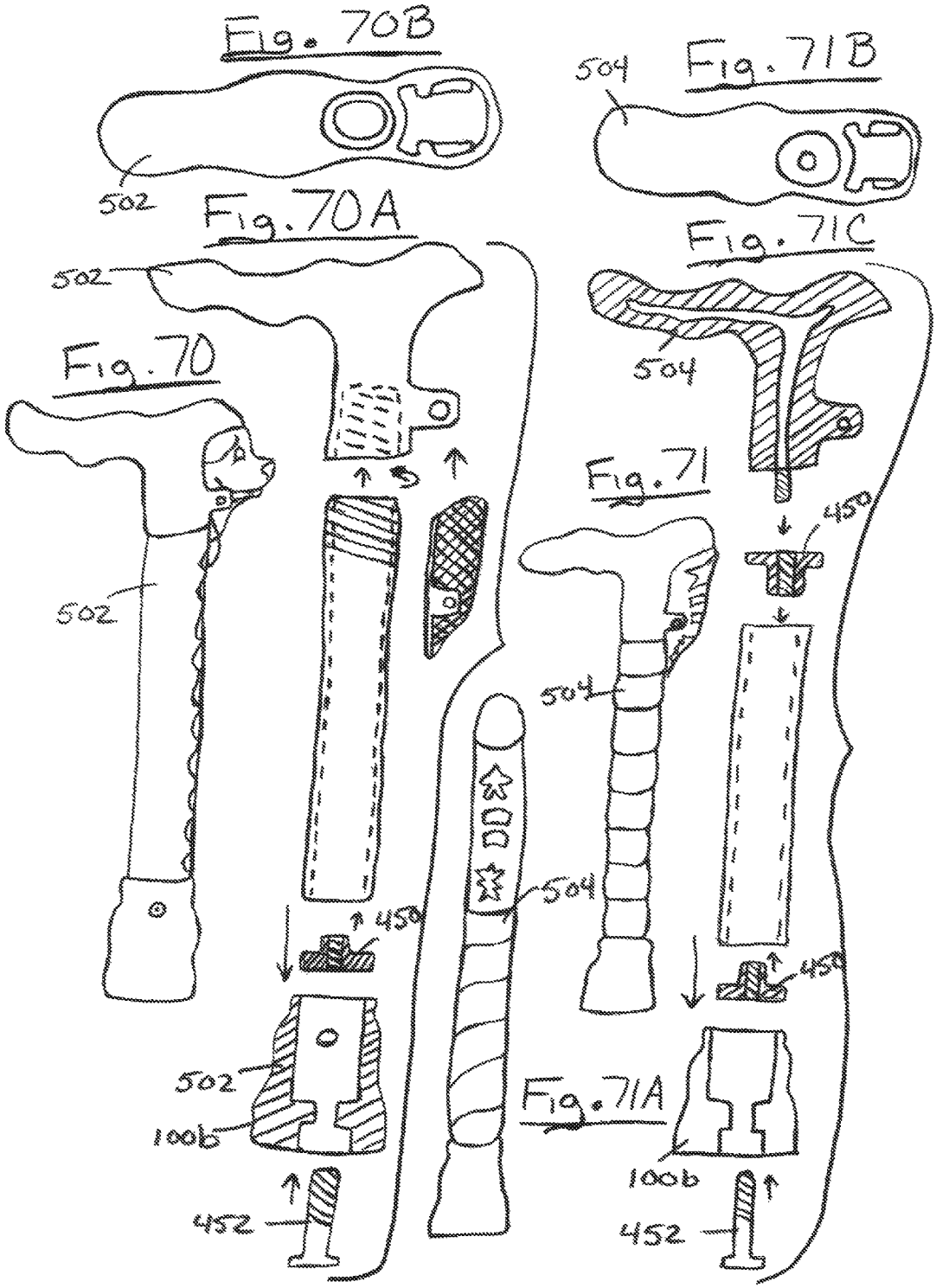
FIG. 70 is a side view of a second embodiment of a cane employing my unique pole tip depicted in FIG. 63.
FIG. 70A is an exploded side view of the second embodiment of the cane shown in FIG. 70.
FIG. 70B is top plan view of the second embodiment of the cane shown in FIG. 70.
FIG. 71 is a side view of a third embodiment of a cane employing my unique pole tip depicted in FIG. 63.
FIG. 71A is a front edge view of the third embodiment of the cane depicted in FIG. 71.
FIG. 71B is an exploded side view of the third embodiment of the s shown in FIG. 71.
FIG. 71C is top plan view of the third embodiment of the cane shown in FIG. 71.

The features of my handicap apparatus include an elevation unit 100 for the elevating the leg of a user while the user is in a seated position as best illustrated in FIGS. 11A and 11B; a unique handle 200 depicted in FIGS. 33 through 39; a snap-on bumper structure 300 shown in FIGS. 48 through 53; and a unique tip cover for a pole of any of my handicap apparatus such as shown in FIGS. 54 through 60 or the cane pole 500 shown in FIGS. 67 through 69, a cane pole 502 shown in FIGS. 70, 70A and 70B, and a cane pole 502 shown in FIGS. 71 and 71A through 71C. One or more of these and other features of my handicap apparatus may be used with crutches 10*a* (FIG. 1), 10*b* (FIG. 2), 10*c* (FIG. 3), and 10*d* (FIG. 4), a wheelchair 180 (FIG. 18), a walker 22 (FIG. 22), a scooter 185 (FIG. 25), and the canes 500 (FIG. 67), 502 (FIG. 70) and 504. (FIG. 71).

There are four embodiments of my unique tip cover. The first embodiment depicted in FIGS. 56 through 60 and generally designated by the number 400*a*. The second embodiment depicted in FIGS. 61, 63, and 67 through 69 and generally designated by the number 400*b*. The third embodiment depicted in FIG. 65 and generally designated by the number 400*c*. The fourth embodiment depicted in FIG. 66 and generally designated by the number 400*d*.

The elevation unit 100 is configured to be mounted to a handicap apparatus such as a crutch, scooter, wheel chair, walker or other handicap apparatus. In the case of a crutch where a pole structure extends from an underarm support member, the elevation unit 100 is attached to the pole structure, lying lengthwise generally along a longitudinal central reference line RL of the crutch. In the case of scooter, wheel chair, walker, the elevation unit 100 is attached to extend from a seat outward horizontally or above the horizontal by no more that 35 degrees. When my method is employed using a crutch as shown in FIGS. 11A and 11B, the patient's leg is horizontally orientated or above the horizontal by no more that 35 degrees.

Figure 18:
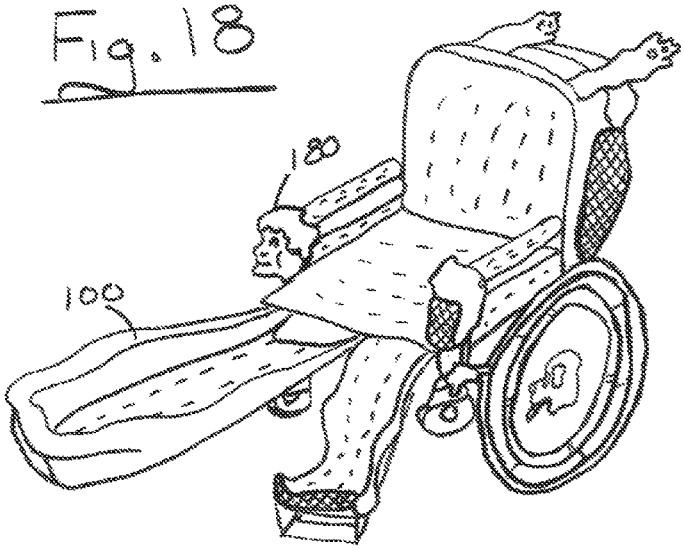
FIG. 18 is a perspective view of a wheel chair employing my elevation unit.
Figure 22:
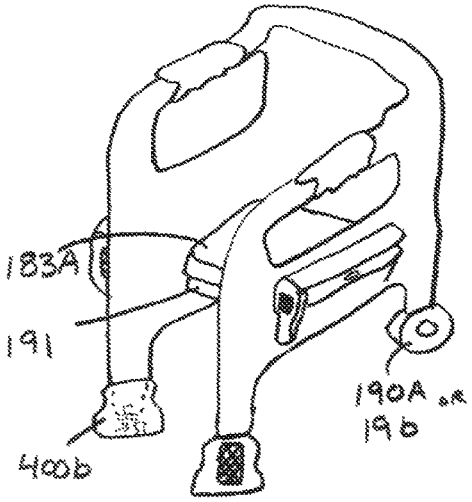
FIG. 22 is a perspective view of a walker having a leg with one of my tip and a support unit to horizontally orient the legs of a user seated on the walker.
Figures 25, 26, 27, 28, 29, 30, 31, 32:
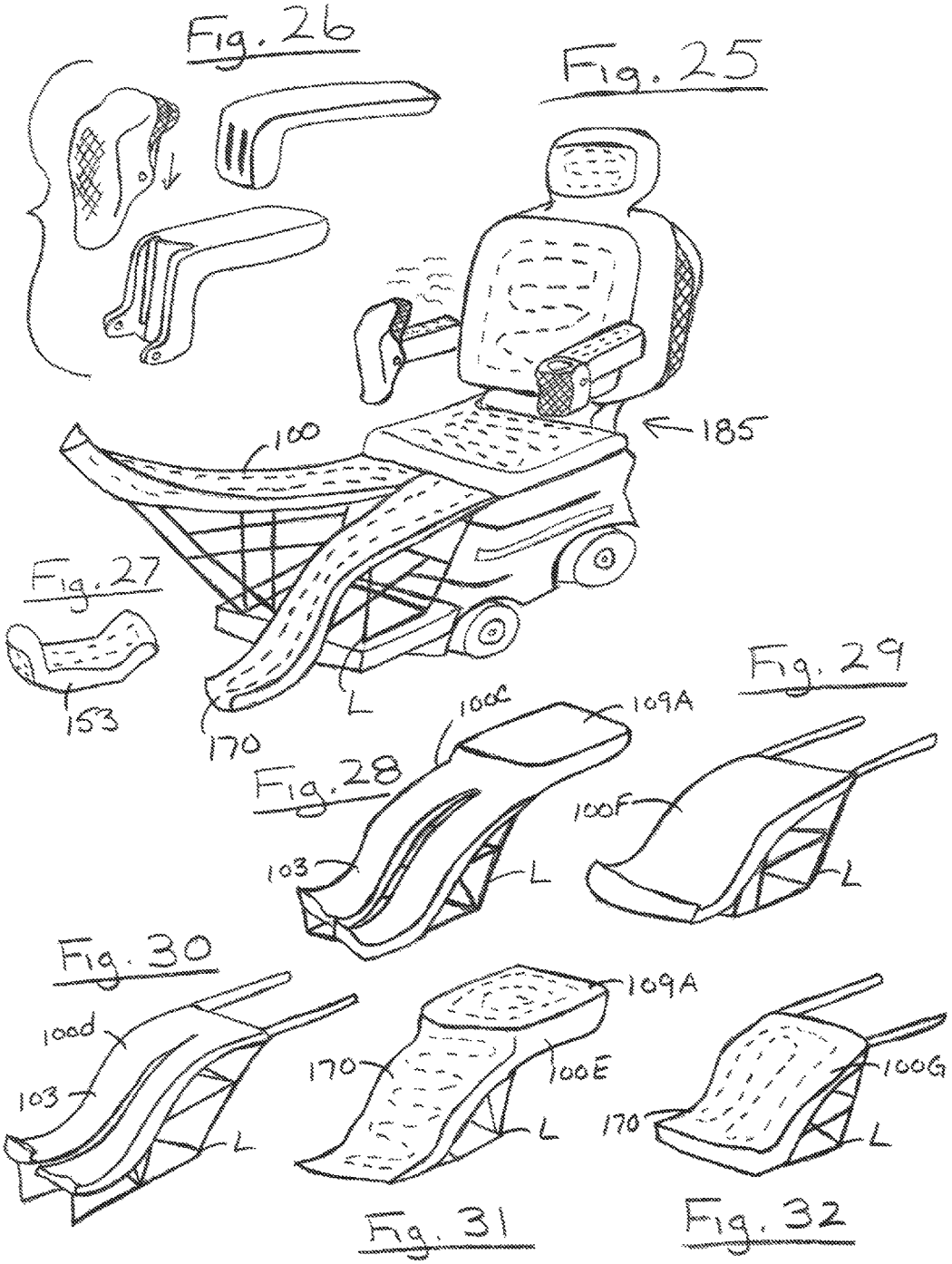
FIG. 25 is a perspective view of scooter using my elevation unit.
FIG. 26 is an exploded perspective view of a cap unit mounted on the end of an armrest of the scooter shown in FIG. 25.
FIG. 27 is a perspective view of an extension member adapted to be attached to an end o the platform of my elevation unit.
FIGS. 28 through 32 are perspective views of alternate embodiments of the elevation unit used with the wheel chair shown in FIG. 25.

FIGS. 18, 22, and 25 depict apparatus for enabling a handicapped user to be seated and mobile, and while seated provides additional elevation for a leg of the user using the elevation unit 100. FIG. 18 shows a wheel chair 180 employing the unit 100; FIG. 22 shows a walker 183 employing either one of the embodiments 100*a* and 100*b* of the elevation unit; and FIG. 25 shows a scooter 185 employing anyone of the embodiments 100*c*, 100*d*, 100*e*, 100*f* and 100*g* of the elevation unit. In the wheelchair 180 the elevation unit 100 is mounted on the wheel chair's leg that has been raised to its maximum height. The unit 100, upon elevation of its platform 103, adds extra height to the raised wheelchair leg.

Figure 23:
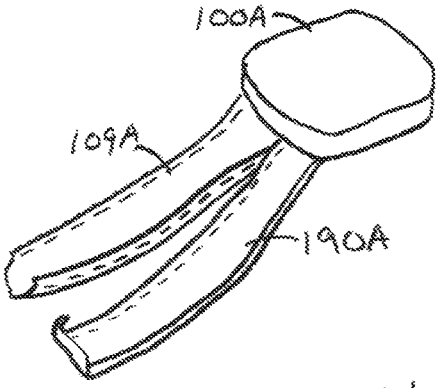
FIG. 23 is a perspective view of one embodiment of the support unit shown in FIG. 22.
Figure 24:
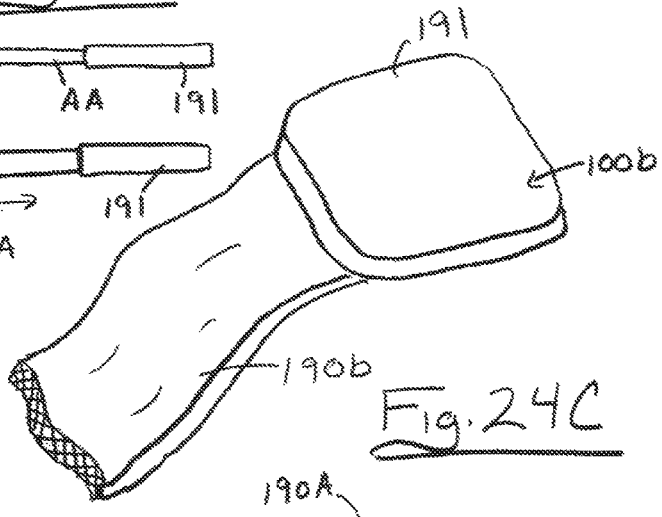
FIG. 24 is a perspective view of a second embodiment of the support unit shown in FIG. 22.
Figure 24A:
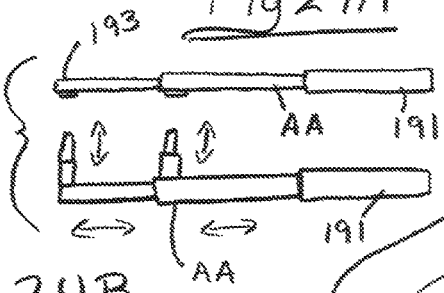
FIG. 24A is a perspective view of one embodiment of an extension system for the support unit shown in FIG. 23 in a partially disassembled condition.
Figure 24B:
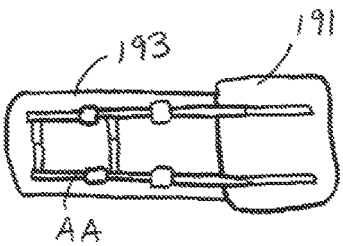
FIG. 24B is a plan view of the extension system shown in FIG. 24A.
Figure 24C:
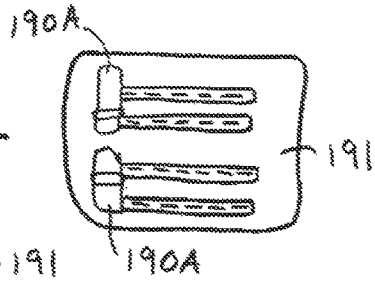
FIG. 24C is a plan view of the extension system in a retracted state.
Figure 24D:
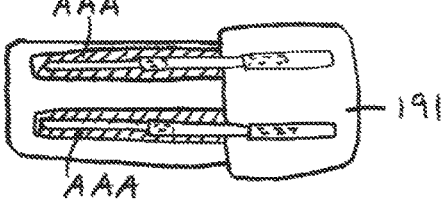
FIG. 24D is a plan view of an alternate embodiment of an extension system for the support unit shown in FIG. 24.

As illustrated in FIGS. 23 and 24, either a support unit 100*a* or unit 100*b* is mounted to the walker 183. These units 100*a* and 100*b* each a case 191 having attached thereto a pad (a pair of pads 190*a* in unit 100*a* and a wide unitary pad 190*b* in unit 100*b*). The case 191 is mounted to an underside of the seat 183*a* of the walker 183 and the pad 190*a* or 190*b* as the case may be is initially rolled up for storage when not in use as shown in FIG. 24C. FIGS. 24A and 24B illustrate an extension system 193 retained in the case 191. The extension system has arms AA interconnected crosswise and that are movable between a retracted state (FIG. 24C) and an extended state (FIG. 24B). In FIG. 24D the alternate embodiment of the extension system for the support unit shown in FIG. 24 has arms AAA that telescope to move between retracted and extended states. In the extended state the extension system 193 unrolls the pad 190*a* or 190*b* as the case may be and provides support for the user's leg or legs in a horizontal orientation or above the horizontal by no more than 35 degrees.

In a similar fashion, the scooter includes the platforms 103 of the elevation units 100*c*, 100*d*, 100*e*, 100*f* and 100*g* that extend at or above the horizontal from the seat 185*a* of the scooter 185. The elevation units 100 may be a pair of platforms or a wider, unitary platform. In either case these units 100 have extendable legs L that allow the platforms 103 to be raised and lowered. The elevation units 100 may also include battery powered heating elements 170 shown in dotted lines and embedded with pillow members 150 or the seat portions 109*a* of the scooter 185. FIG. 26 shows a cap member 185*b* attached by a two-component bracket 185*c* to the end of an arm of the scooter 185. The cap member may be made of rubber or be a battery powered light. The rubber's density may vary to provide a softer exterior and a harder interior. FIG. 27 illustrates an extension member 153 adapted to be attached to an end o the platform of my elevation unit.

As best shown in FIGS. 10A through 10M, a lifting mechanism 600 is used that enables a patient to manually move the platform 103 between first and second elevated positions and also move the elevated platform laterally. The lifting mechanism 600 comprises a forward mount 610 and a rearward mount 620 connected by a pair of L-shaped legs L1 and L2, with opposed ends of a pair of leg segments a1 and b1 of the L-shaped legs respectively attached to either mount 610 or 620 as the case may be. The forward segments a1 of the L-shaped legs are telescoped so the multiple components of segments a1 and b1 collapse into each other to lower the platform 103. The platform 103 is manually raised by pulling on the collapsed multiple components to elevate the forward end of the platform.

Figure 10:
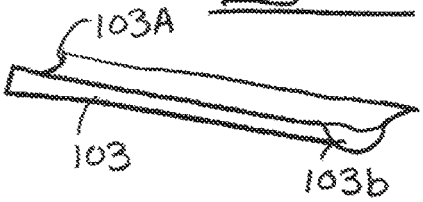
FIG. 10 is a perspective view a platform member of the elevation unit.
Figure 10A:
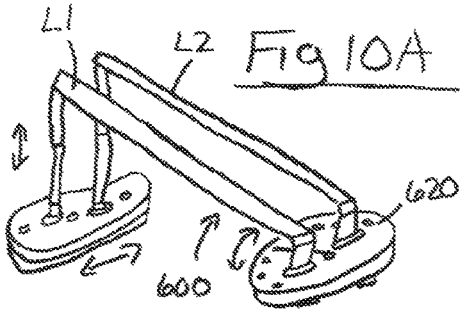
FIG. 10A is a perspective view a lift mechanism for the platform member of the elevation unit with the platform in a central start orientation.
Figure 7:
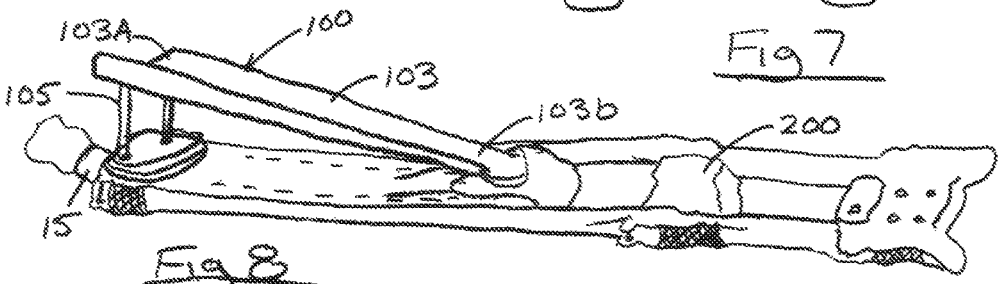
FIG. 7 is a perspective view of the fifth embodiment with the elevation unit in one configuration raised at one end.
Figures 10B, 10C, 10D, 10E, 10F, 10G, 10H, 10I, 10J, 10K, 10L, 10M, 10N:
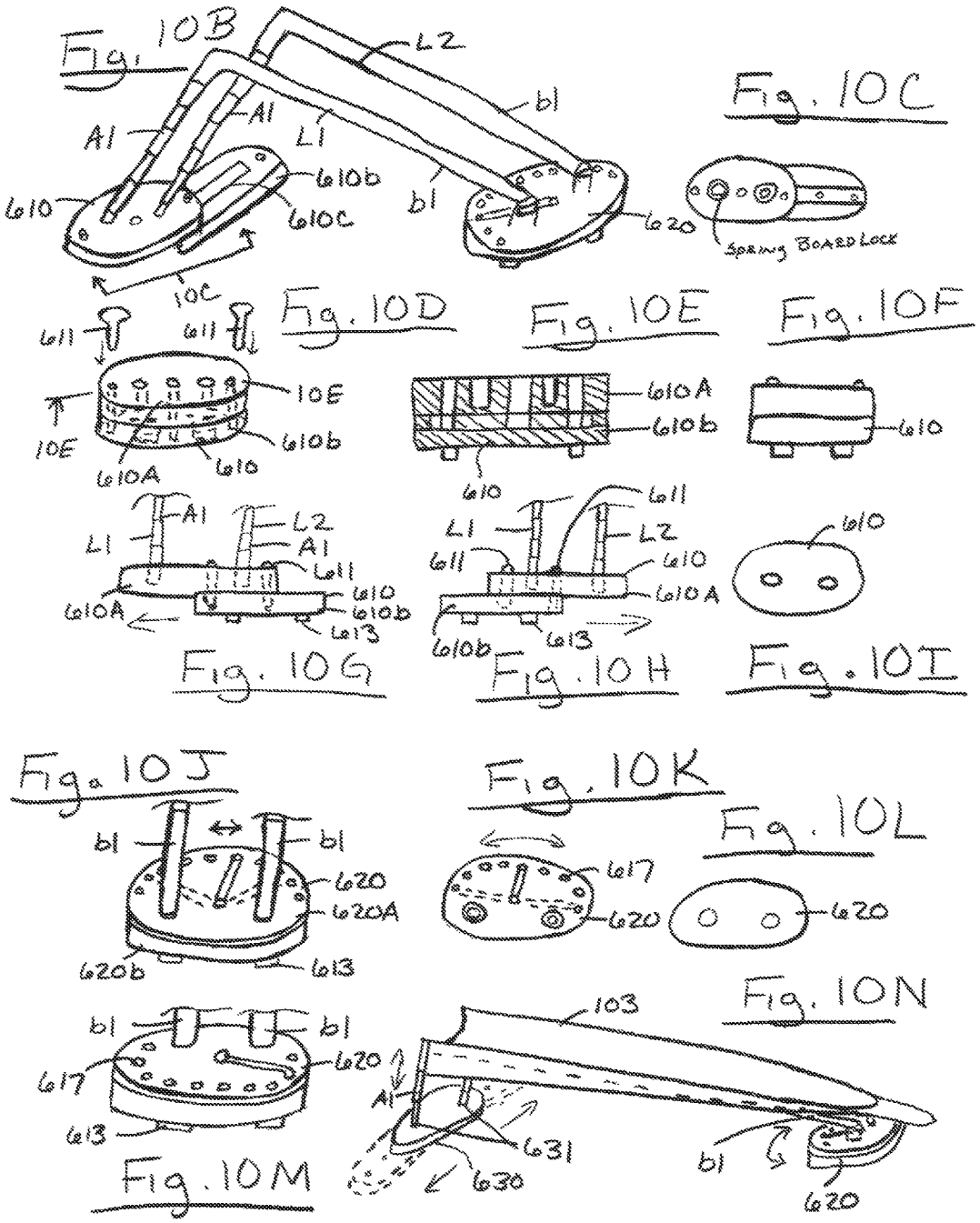
FIG. 10B is a perspective view of the lift mechanism shown in FIG. 10A with its platform repositioned.
FIG. 10C is a fragmentary plan view taken along line 10C-10C of FIG. 10B.
FIG. 10D is an exploded perspective view of the outer base of the lift mechanism shown in FIG. 10A.
FIG. 10E is a cross-sectional view taken along line 10C-10C of FIG. 10B.
FIG. 10F is a side view of the outer base of the lift mechanism shown in FIG. 10D.
FIG. 10G is a side view of the outer base of the lift mechanism with its upper disk moved to the left.
FIG. 10H is a side view of the outer base of the lift mechanism with its upper disk moved to the right.
FIG. 10I is a plan view the outer base of the lift mechanism shown in FIG. 10A.
FIG. 10J is a perspective view of the inner base of the lift mechanism shown in FIG. 10A.
FIG. 10K is a plan top view of the inner base of the lift mechanism shown in FIG. 10A.
FIG. 10L is a plan bottom view of the inner base of the lift mechanism shown in FIG. 10A.
FIG. 10M is a perspective view of the inner base of the lift mechanism with its upper disk repositioned from that depicted in FIG. 10J.
FIG. 10N is a perspective view of an alternate lift mechanism.

As shown in FIGS. 10D through 10I, the forward mount comprises a pair of circular disks 610*a* and 610*b* of the same diameter overlying each other that are attached together to side latterly along a slot 610*c*. Spring loaded pins 611 hold the disk together but are manually lifted to disengage and allow the upper disk 610*a* to move either to the right (FIG. 10G) or left (FIG. 10H). In the bottom of the disk 610*b* are a pair of feet 613 that project outward from the bottom of the disk 610*b* and fit into orifices in the handicap apparatus to attach the mount 610 thereto. As shown in FIGS. 10J through 10M, the mount 620 includes a pair of circular disks 620*a* and 620*b* of the same diameter overlying each other and attached together to rotate relative to each other. An arm 615 that has an end that fits into holes 617 in the upper disk 620*a* will drop into position as the upper disk moves relative to the lower disk. There is a pair of feet 613 that projects outward from the bottom of the disk 620*b* and fit into orifices in the handicap apparatus to attach the mount 620 thereto. As shown in FIG. 10N an alternate lifting mechanism is depicted similar to that discussed above but uses at the forward end a mount 630 with telescopic legs 631. This mount may simply be shifted from side to side after raising the legs 631.

Figure 8:
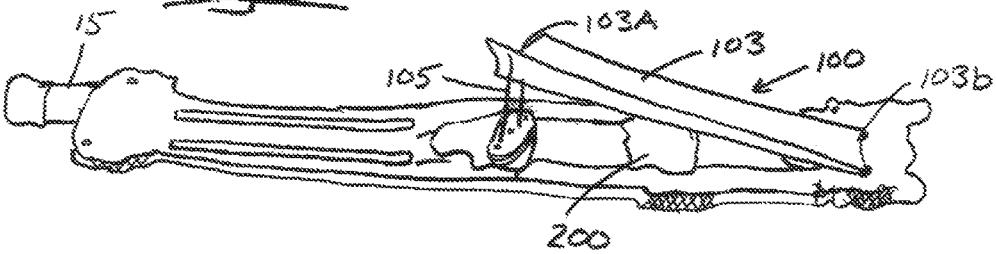
FIG. 8 is a perspective view of the fifth embodiment with the elevation unit in an alternate configuration and raised at one end.
Figure 19:
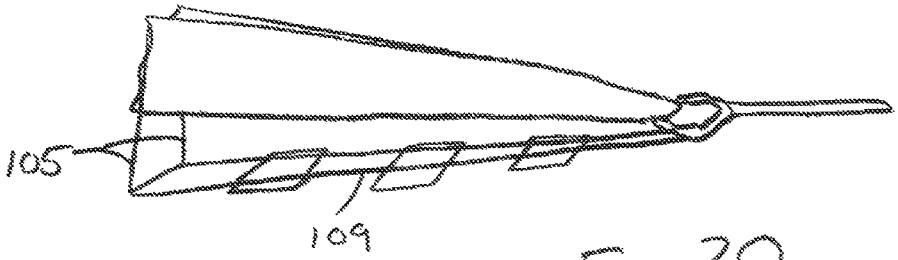
FIG. 19 is a side view of my elevation unit shown in FIG. 18.
Figure 20:
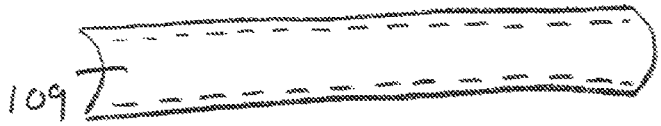
FIG. 20 is a bottom view my elevation unit shown in FIG. 18.
Figure 21:
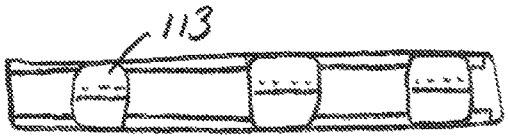
FIG. 21 is a side view an alternate my elevation unit with straps for holding the unit in position.

As illustrated in FIGS. 11A and 11B, the elevation unit 100 mounted to a crutch 650 is also used to elevate the leg of a user while the user is in a seated position. In this case the crutch is positioned to lean against a seat upon which a patient sits. The elevation unit 100 comprises an elongated platform 103 (FIG. 10) having opposed ends 103*a* and 103*b* and being moveable between a first position where the end 103*a* of the platform is elevated with respect to the end 103*b* of the platform. For example, the end 103*b* may be mounted to enable the platform to pivot about this end 103*b*. The unit 100 includes legs 105 that are extended upon elevating the platform 103. The platform 103 may also be mounted as shown in FIG. 8. As shown in FIGS. 19 through 21, the elevation unit 100 may have a joint at the end 103*b* that allows the platform 103 to pivot and also move laterally from side to side. A sheath 109 with straps 113 allows a user to wrap the sheath around the platform 103 and hold in position using the straps 113.

Figure 9:
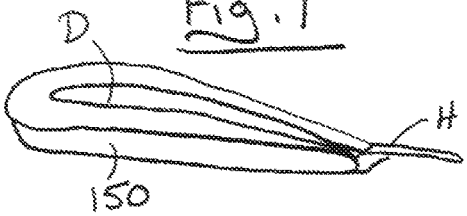
FIG. 9 is a perspective view a pillow member used with the fifth embodiment of my crutch.
Figure 5:
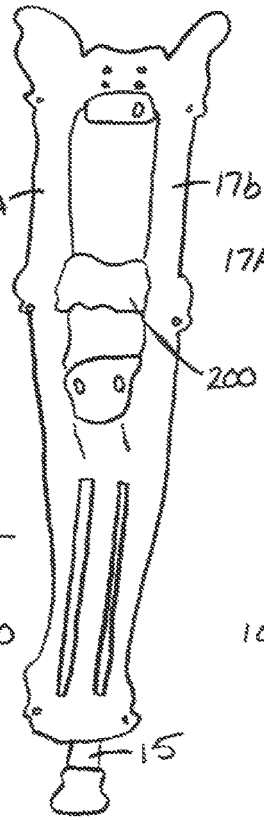
FIG. 5 is a front side view of a fifth embodiment of my crutch with the elevation unit removed.
Figure 6:
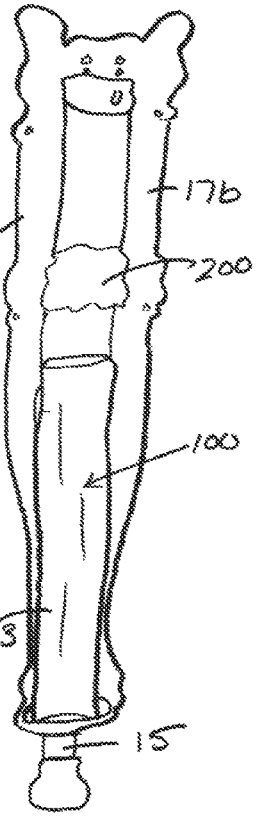
FIG. 6 is a front side view of the fifth embodiment of my crutch with the elevation unit attached.
Figure 14:
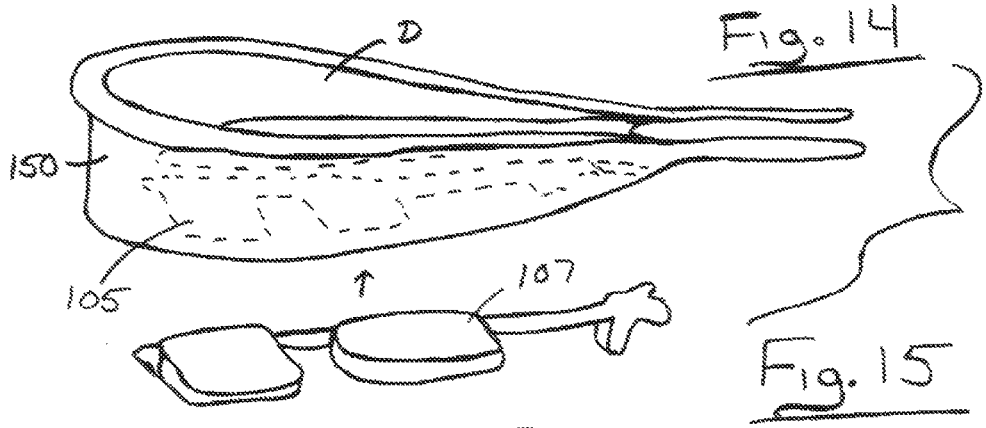
FIG. 14 is a perspective view of pillow member to be used with a leg rest of the wheel chair shown in FIG. 19.
Figure 15:
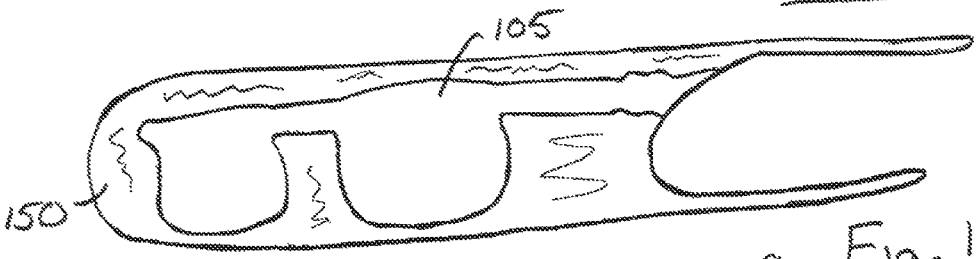
FIG. 15 is a bottom view of the pillow member shown in FIG. 14.
Figure 16:
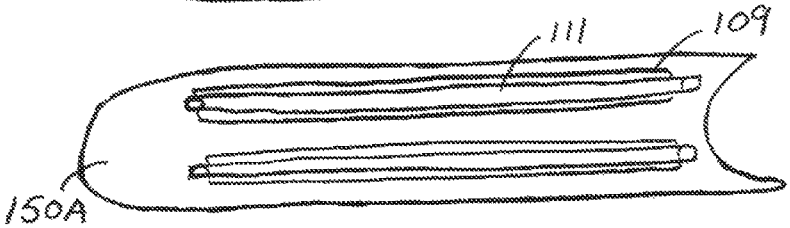
FIG. 16 is a bottom view of another alternate pillow member.
Figure 17:
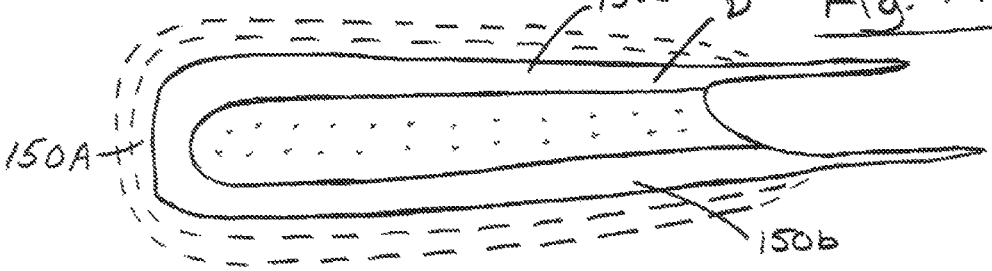
FIG. 17 is a top plan view of the alternate pillow member shown in FIG. 16.

As shown in FIGS. 9 and 12 through 17, a cup shaped pillow member 150 may be used to cover the platform 103 and provide a soft comfortable support for the user's leg. As shown in FIG. 9, the pillow member 150 includes a central depression D and may be detachably connected to the platform 103 by a hook H at an end of the depression. As illustrated in FIG. 14, the flat underside of the pillow member 150 may have a precisely configured indentation 105 (FIG. 15) that conforms in shape to a leg rest 107 of a wheelchair. FIGS. 16 and 17 depict a pillow member 150*a* with elongated slots 109 in its flat underside that receive finger elements that fit in the slots to hold the pillow member in position. The pillow member 150 or 150*a* may have sides 150*b* that stretch as shown in dotted lines in FIG. 17. The pillow member 150 may have a blanket 160 component attached along an edge 161 that may be placed over the user's leg when the leg is seated in the depression D.

Figure 1:
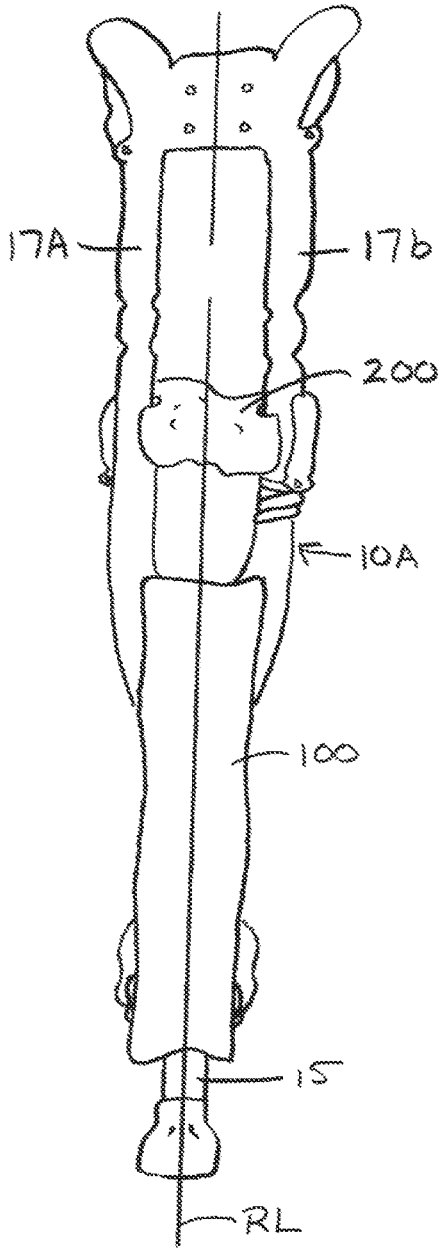
FIG. 1 is a front side view of one embodiment of my crutch without insulating material and including an elevation unit.
Figure 2:
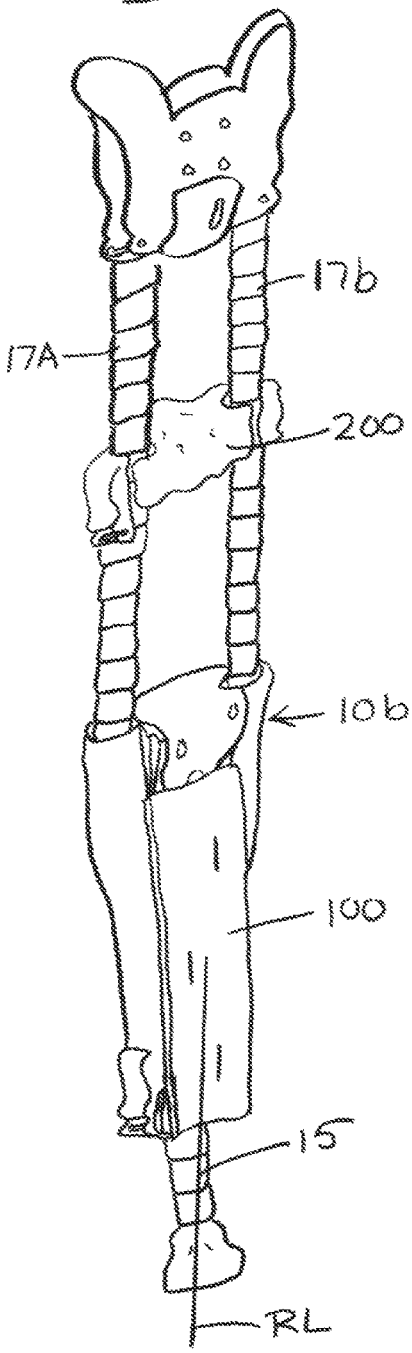
FIG. 2 is a perspective view of another embodiment of my crutch with a band of insulating material wrapped around poles of the crutch and including an elevation unit.
Figure 3:
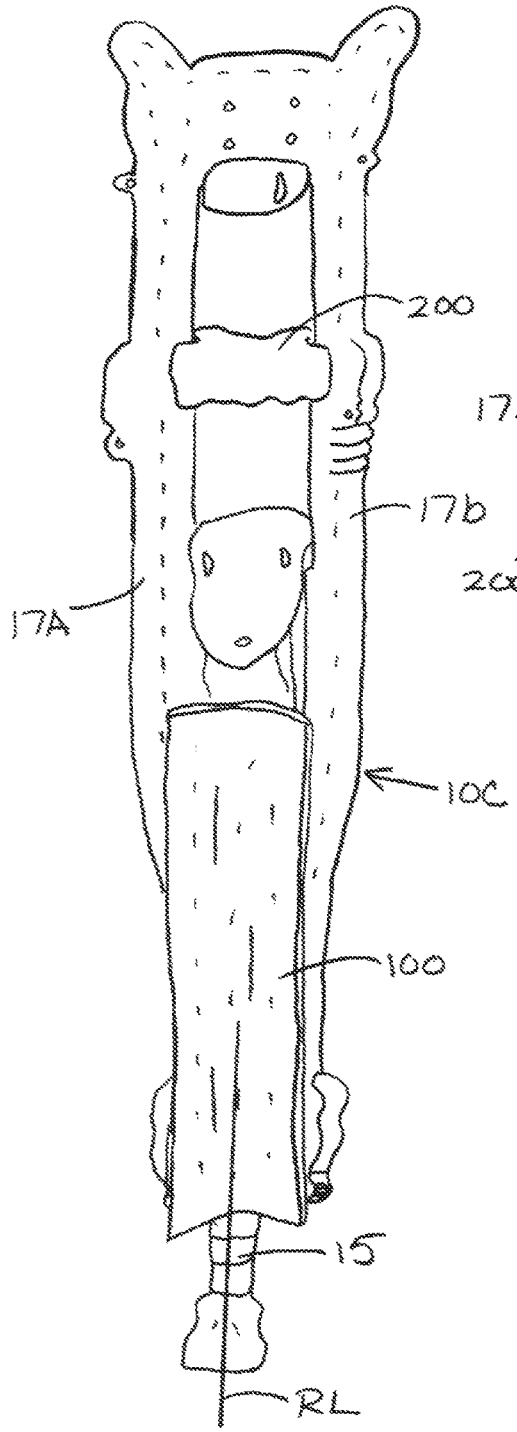
FIG. 3 is a front side view of a third embodiment of my crutch having an insulating sheath covering its poles and including an elevation unit.

The crutches 10*a* through 10*d* are similar to those illustrated in the Parent Application, with the crutches depicted in FIGS. 1 through 3 including my elevation unit 100. The crutch 10*d* shown in FIG. 4 employs a plurality of snap-on bumper structure 300 and a snap-on light element 13. The crutches 10*a* through 10*d* all include an elongated center pole 15 positioned between lower portions of a pair of side poles 17*a* and 17*b*. The side poles 17*a* and 17*b* and center pole 15 are connected together into an assembly where the center pole extends along the longitudinal central reference line RL and the side poles straddle the reference line. All the poles 17*a*, 17*b* and 15 lie in the same plane and are parallel to each other. A plurality of resilient, snap-on bumper structures may be mounted to one or more of the poles in a manner to project outwardly from the pole and lie generally in the same plane as the assembled poles 17*a*, 17*b* and 15.

Figures 40, 41, 42, 43, 44, 45, 46, 47, 48, 49, 50, 51, 52, 53:
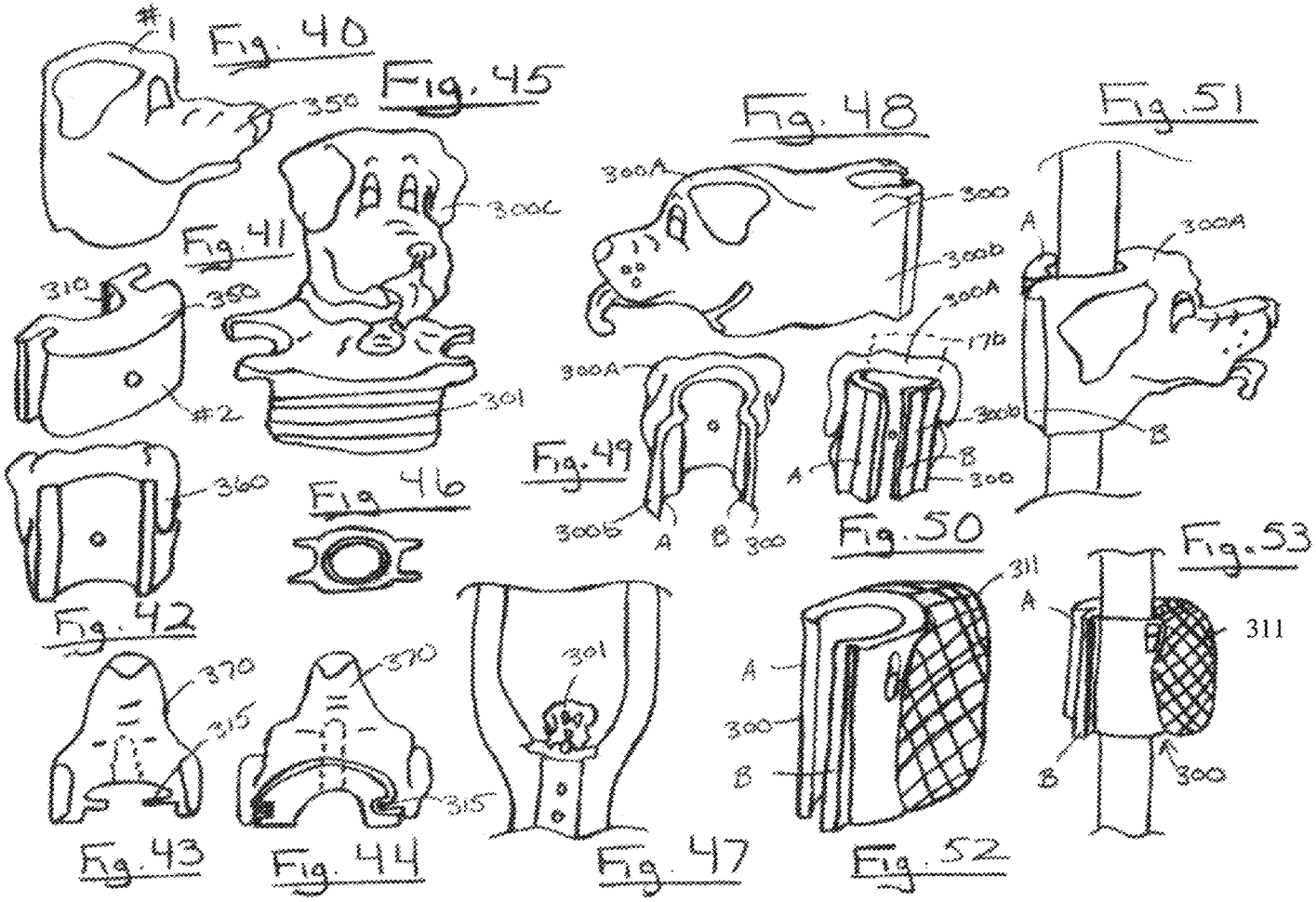
FIGS. 40 through 53 illustrate cap members used with my crutch and apparatus where
Figure 54:
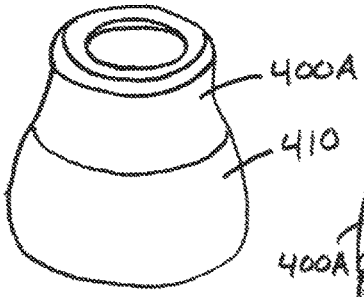
FIGS. 54 through 61 illustrate tip covers mounted on the end of a crutch pole where
Figure 55:
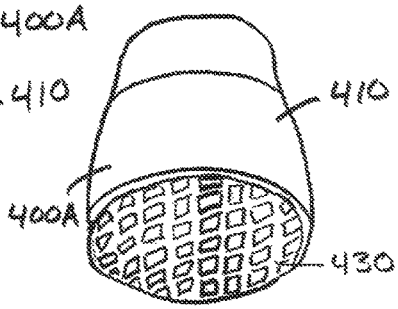

As shown in FIGS. 48 through 50 the bumper structures 300 are unitary molded rubber pieces that include an enlarged portion 300*a* and a coupling portion 300*b* rearward of the enlarged portion 300*a*, which may be in the form of an ornament, for example, a dog's head. The enlarged portion 300*a* projects outwardly away from a pole upon attachment. The coupling portion 300*b* includes a pair of fingers A and B that are spring biased. The fingers A and B have an open configuration shown in FIG. 49 and a closed configuration shown in FIG. 50, for example, the finger A and B wrap around the pole 17*a* upon being manually pushed together. A light 311 may be mounted to a pole in a similar manner as shown in FIGS. 52 and 53.

Figure 4:
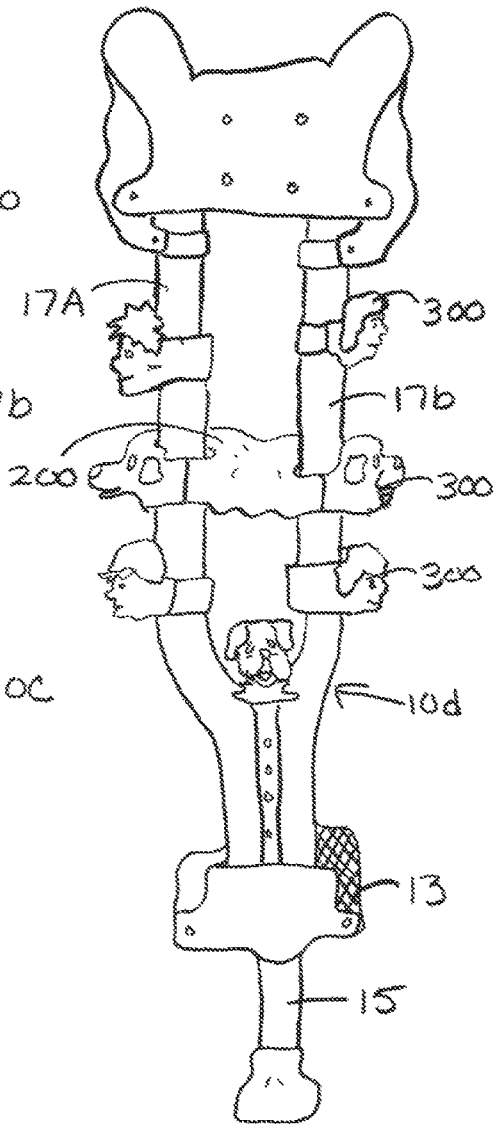
FIG. 4 is a front side view of a forth embodiment of my crutch having a varying density, rigid handle connecting side poles and a cap member on a center pole.

As shown in FIG. 4, an upper end portion of the center pole 15 has a cap member such as the bumper structure 300 attached thereto. This bumper structure 300*c* is similar to the bumper structure 300. Instead of a snap-on mounting device, as shown in FIGS. 45 and 46 bumper structure 300*c* lower portion 301 is threaded and screws into an internal thread (not shown) at the upper end of the center pole 15. In general, a bumper structure 350 may have two components #1 and #2 as shown in FIGS. 40 and 41, and have an external flange 310. Also in general, a bumper structure 360 (FIG. 42) may have an external flange 310, or a bumper structure 370 (FIGS. 43 and 44) may have an external flange 315.

The various bumper structures 300, 300*c*, 350, 360, and 370 may comprise a resilient rubber body that varies in density to provide a softer exterior and a harder interior.

As shown in FIGS. 33 through 39 a connector element attaching the poles 17*a* and 17*b* together functions as a handle 200 that extends between these side poles and is positioned so a user can grasp the handle while using the crutch. As illustrated in FIG. 37, the handle 200 has a resilient body B that varies in density to provide a softer exterior and a harder interior. Goodyear Rubber Company is expert in making rubber structures that vary in density in this manner.

Figure 56:
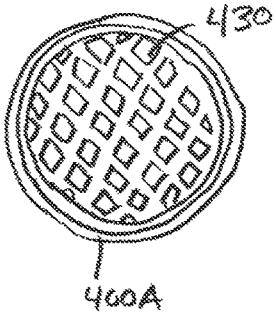
Figure 57:
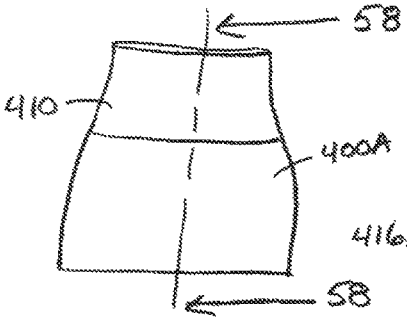
Figure 58:
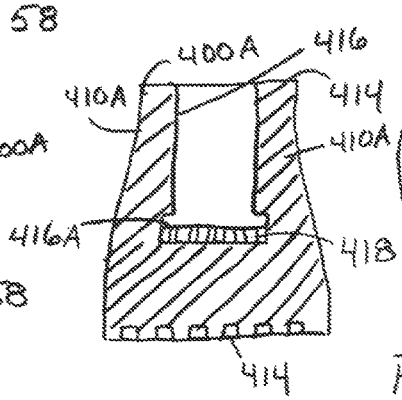
Figure 59:
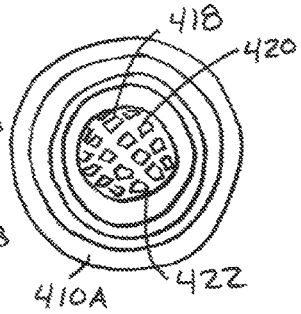
Figure 60:
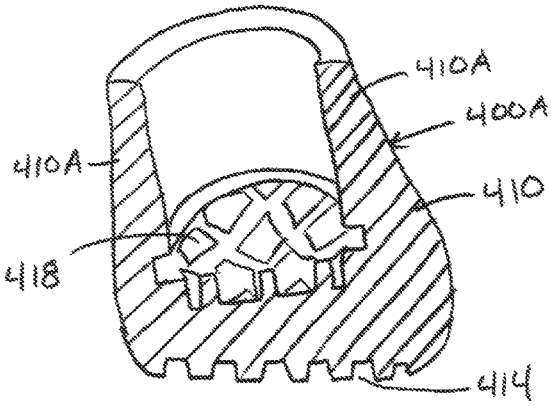
Figure 61:
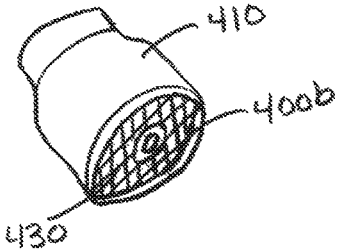

As shown in FIGS. 54 through 60 and FIGS. 67 through 69, my tip cover may be used with a crutch pole, for example, the pole 15, or a cane 500. All the embodiments of my tip cover have a rubber body 410 generally in the shape of a truncated cone. As best shown in FIG. 58, this body 410 has a generally flat bottom 412 and a flat top 414 having a receptacle 416 therein in the form of a cylinder that is configured to receive the end of the pole 15 or cane 500 as the case may be. As best shown in FIG. 56, molded into the bottom of the receptacle 416 is a disk shaped matrix 418 of adjacent diamond shaped opening 420 within a circular rim 422 having a diameter the same as the diameter of the cylindrical receptacle 416. As best shown in FIGS. 56 and 61, in the bottom 412 are crisscrossing grooves 430.

Figures 62, 63, 64, 65, 66:
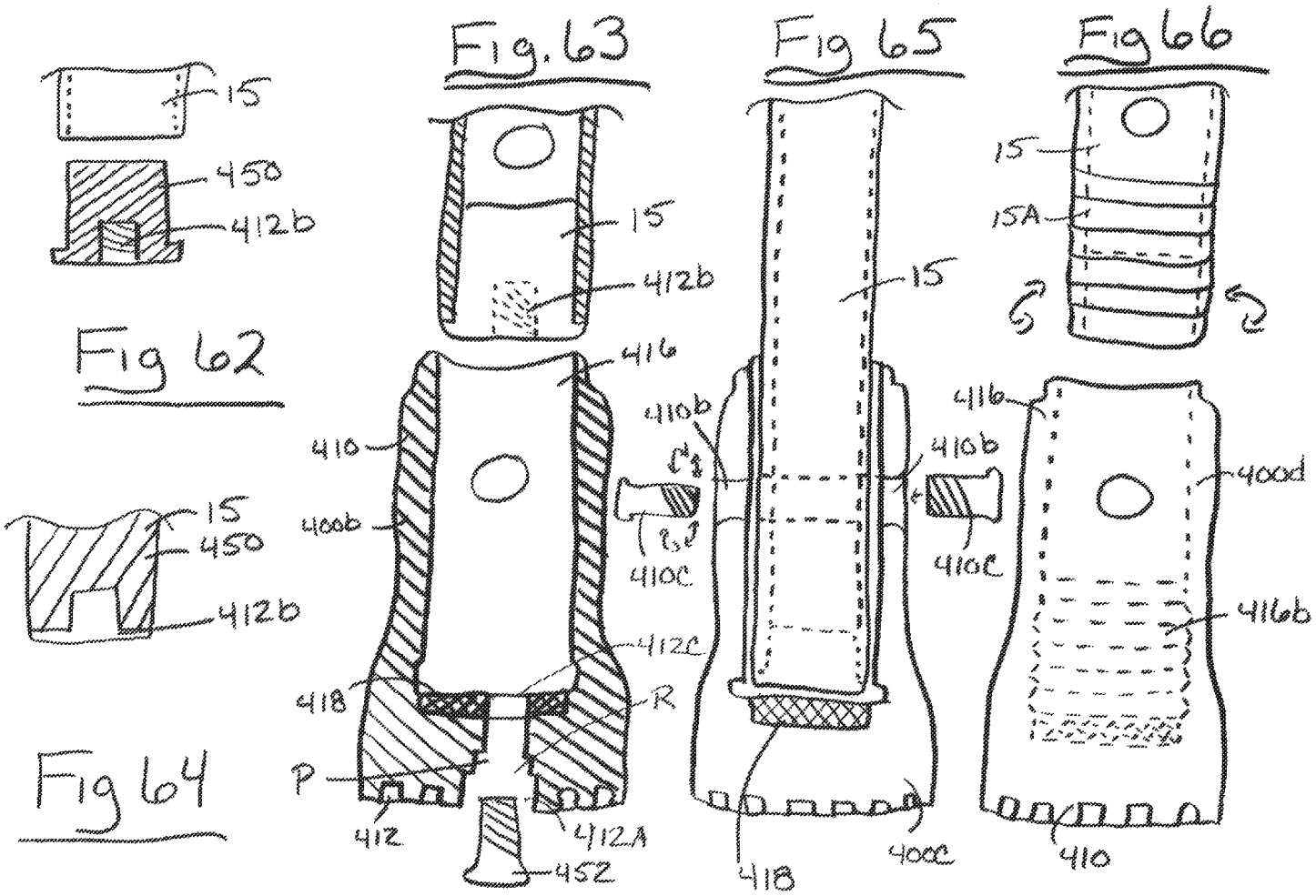
FIG. 62 is a fragmentary cross-sectional view of the bottom portion of my handicap apparatus having a plug being inserted into an open bottom end of a pole of my handicap apparatus.
FIG. 63 is a fragmentary cross-sectional view of the bottom portion of my handicap apparatus showing one embodiment of my unique pole tip.
FIG. 64 is a fragmentary cross-sectional view similar to that of FIG. 62 showing the plug inserted into the open bottom end of a pole of my handicap apparatus.
FIG. 65 is a fragmentary cross-sectional view of the bottom portion of my crutch showing a second embodiment of my unique pole tip.
FIG. 66 is a fragmentary cross-sectional view of the bottom portion of my crutch showing a third embodiment of my unique pole tip.

In the tip cover 400*a* there are no openings in a sidewall 410*a* (FIGS. 58 and 61) of the body 410. The receptacle 416 of the tip cover 400*a* has tight dimensions so the end of the pole 15 fits snug and the elastic character of the rubber body 410 holds the tip cover in place. Whereas in the tip cover 400*c* there is a pair of aligned openings 410*b* in this cover's sidewall. As shown in FIG. 65, upon inserting the end of the pole 15 into the receptacle 416 and moving the pole inward to bear against the matrix 418, fasteners such as screws 410*c* are screwed into the openings 410*b* so their ends press against the pole 15 to hold the tip cover in place.

As shown in FIGS. 61 and 63, the bottom 412 of the tip cover 400*b* has a central opening 412*a* therein that is in communication with an aligned central opening 412*c* in the matrix 418 to form a passageway through the tip cover's bottom into the receptacle 416. As depicted in FIGS. 62 and 64, a plug 450 is inserted into the open end of any of the poles 15. A central threaded receptacle 412*b* in a face end of the plug provides an attachment site that is aligned with the openings 412*a* and 412*c* forming the passageway. This passageway terminates in a recess near the bottom 412, and a threaded fastener 452 extends through the passageway P. A first end of the fastener 452 attaches to the site by being screwed into the receptacle 412*b*, pulling the rim 422 of the plug 450 snug against the floor of the receptacle 416 in the rubber body 410, and a second end that is seated in the recess R inward of the bottom 412. A central threaded receptacle 412*b* in the plug 450 is aligned with the openings 412*a* and 412*c* and a screw 452 is screwed into the receptacle 412*b* to hold the tip cover 400*b* in place.

In the tip cover 400*d*, the end 15*a* of the pole 15 is threaded and the lower inside surface 416*b* of the receptacle 416 has corresponding threads so that the end of the pole is screwed into the receptacle as shown in FIG. 66.

The Goodyear Rubber Company can manufacture such tip covers using conventional molding techniques.

SCOPE OF THE INVENTION

The above presents a description of the best mode I contemplate of carrying out my handicap apparatus and of the manner and process of making and using my handicap apparatus, in such full, clear, concise, and exact terms as to enable a person skilled in the art to make and use. My handicap apparatus and method of use, however, are susceptible to modifications and alternate constructions from the illustrative embodiments discussed above which are fully equivalent. Consequently, it is not the intention to limit my handicap apparatus and method of use to the particular embodiments disclosed. On the contrary, my intention is to cover all modifications and alternate constructions coming within the spirit and scope of my handicap apparatus and method of use as generally expressed by the following claims, which particularly point out and distinctly claim the subject matter of my invention:

The invention claimed is:

1. An elevation unit for elevating a leg of a user while the user is in a seated position comprising:

an elongated platform configured to be mounted to a handicap apparatus, said elongated platform having a predetermined shape enabling the leg of a user to be positioned comfortably lengthwise along the platform, and said elongated platform having opposed ends and being moveable between a first position where a first end of the platform is elevated with respect to a second end of the platform; and a lifting mechanism that enables a user to manually move the platform between the first and second positions and move the elevated platform laterally, the lifting mechanism comprising:

a forward mount connected to a first end of the platform;

a rearward mount connected to a second end of the platform;

a first leg having a first end connected to the forward mount and a second opposing leg connected to the rearward mount; and a second leg having a first end connected to the forward mount and a second opposing leg connected to the rearward mount; and where the first ends of the first and second legs include a plurality of telescoping segments configured to expand or collapse to raise or lower the elongated platform.

2. The elevation unit of claim 1 the platform includes a pillow member that at least partially covers the platform.

3. The elevation unit of claim 2 where the pillow member is detachably connected to the platform.

4. The elevation unit of claim 1 where the second end is mounted to pivot and the platform includes legs at the first end that are extended upon elevating the platform into the first position.

5. The elevation unit of claim 1, wherein the first and second legs are L-shaped.

6. The elevation unit of claim 1, wherein the forward mount comprises a first circular disk mounted on a second circular disk and secured together by one or more spring loaded pins.

7. The elevation unit of claim 6, wherein the first circular disk slides laterally along a slot in the second circular disk.

8. A crutch comprising an underarm support member from which extends a pole structure, and an elevation unit attached to the pole structure, said elevation unit comprising an elongated platform having opposed ends and moveable between a first position where a first end of the elongated platform is elevated with respect to a second end of the platform, the elevation unit further comprising:

a forward mount connected to the first end of the elongated platform;

a rearward mount connected to the second end of the elongated platform;

a first leg having a first end connected to the forward mount and a second opposing leg connected to the rearward mount; and a second leg having a first end connected to the forward mount and a second opposing leg connected to the rearward mount; and where the first ends of the first and second legs include a plurality of telescoping segments configured to expand or collapse to raise or lower the elongated platform.

9. The crutch of claim 8 where the second end is attached to the pole structure to pivot inward and outward with respect to the pole structure and laterally from side to side and the first end includes legs that hold the platform the first position.

10. The elevation unit of claim 8, wherein the forward mount comprises a first circular disk mounted on a second circular disk and secured together by one or more spring loaded pins.

11. The elevation unit of claim 10, wherein the first circular disk slides laterally along a slot in the second circular disk.

12. The elevation unit of claim 8, wherein the first and second legs are L-shaped.

* * * * *